US007494421B2

(12) United States Patent
Elkins

(10) Patent No.: US 7,494,421 B2
(45) Date of Patent: Feb. 24, 2009

(54) SYSTEM, METHOD, AND APPARATUS FOR ATHLETIC SWING TRAINING

(76) Inventor: Danny Elkins, 305 Cox Rd., Roswell, GA (US) 30075

( * ) Notice: Subject to any disclaimer, the term of this patent is extended or adjusted under 35 U.S.C. 154(b) by 103 days.

(21) Appl. No.: 11/053,299

(22) Filed: Feb. 7, 2005

(65) Prior Publication Data

US 2005/0176519 A1 Aug. 11, 2005

Related U.S. Application Data

(60) Provisional application No. 60/542,804, filed on Feb. 6, 2004.

(51) Int. Cl.
*A63B 69/36* (2006.01)

(52) U.S. Cl. ..... 473/258; 473/260

(58) Field of Classification Search ..... 473/258–260, 473/229, 226, 257, 461, 453
See application file for complete search history.

(56) References Cited

U.S. PATENT DOCUMENTS

| | | | | | |
|---|---|---|---|---|---|
| 1,567,530 | A * | 12/1925 | MacNaughton et al. | ..... | 473/229 |
| 3,953,035 | A * | 4/1976 | Beckisk | ..... | 473/229 |
| 4,133,535 | A * | 1/1979 | Marsh | ..... | 473/229 |
| 5,072,942 | A * | 12/1991 | Hurley | ..... | 473/229 |
| 5,911,635 | A * | 6/1999 | Ogden | ..... | 473/224 |
| 6,923,727 | B1 * | 8/2005 | Jacobs | ..... | 473/206 |
| 2005/0075186 | A1 * | 4/2005 | Liao | ..... | 473/259 |
| 2005/0176519 | A1 * | 8/2005 | Elkins | ..... | 473/258 |
| 2005/0266928 | A1 * | 12/2005 | Jacobs | ..... | 473/201 |

* cited by examiner

*Primary Examiner*—Raleigh W. Chiu
(74) *Attorney, Agent, or Firm*—Thomas, Kayden, Horstemeyer & Risley, LLP

(57) ABSTRACT

A system for swing training including a swing plane component defining a predefined plane around an athlete, a planar guidance component configured to guide a striking member along the predefined plane, and a securing member configured to couple the planar guidance component to the striking member.

8 Claims, 10 Drawing Sheets

SYSTEM, METHOD, AND APPARATUS FOR ATHLETIC SWING TRAINING

CROSS REFERENCE TO RELATED APPLICATIONS

This application claims the benefit of U.S. Provisional Application No. 60/542,804, filed Feb. 6, 2004, which is hereby incorporated by reference in its entirety.

TECHNICAL FIELD

This disclosure generally relates to an athletic training aid for swinging a striking member, such as a golf club, baseball bat, tennis racket, etc. and, more particularly, to a system, method, and apparatus for maintaining a proper swing plane.

BACKGROUND

Many sports involve striking a ball or other object with a club, bat, paddle, racket, or other striking member. As participants in these sports work to improve their abilities, most strive to improve their "swing plane." Generally speaking, an athlete participating in such a sport wishes to swing the striking member around his or her body, while keeping the striking member along a predefined plane, known as the swing plane. A proper swing plane is an imaginary plane aligned with the path of intended ball flight. As the athlete swings the striking member, the striking member should remain adjacent to the proper swing plane throughout the duration of the swing. As is evident, variance from the proper swing plane during the swing increases the probability of miss-hitting the ball. An athlete trained to maintain the proper swing plane throughout the swing will not only miss-hit the ball less often, but the resultant error from a miss-hit will also be reduced.

In striving to teach athletes to maintain a proper swing plane throughout the swing, some have simulated the imaginary swing plane with a swing plane component, such as a plastic window pane, piece of plywood, or other thin, planar material with a hole cut through the center of it. This swing plane component is placed with the athlete standing in the hole and angled to simulate the proper swing plane for the athlete participating in that particular sport. Once fixed in the appropriate position, the athlete practices the swing plane by repeatedly swinging a striking member, such as a golf club, baseball bat, or other similar piece of equipment, while keeping the striking member adjacent to the swing plane component throughout the swing. With repeated practice using the swing plane component, the intended result is that when the swing plane component is removed, the athlete will maintain the proper swing plane throughout the swing, thereby improving performance in the desired activity.

However, problems often arise when using a swing plane component. For example, the athlete may wish to keep the striking member in contact with the swing plane component. However, such contact could cause unnecessary wear on the striking member, cause injury to the athlete, and/or provide inadequate or incorrect feedback regarding the athlete's swing plane.

Alternatively, the athlete may wish to maintain the striking member a predetermined distance from the swing plane component, to allow freedom of motion throughout the swing. However, problems arise as it may become difficult to receive adequate feedback while maintaining concentration on striking a ball. Such a configuration reduces the effectiveness of the swing plane component.

Additionally, while the swing plane component provides feedback on the swing plane, it provides little feedback regarding the position of the athlete's arms, hands, shoulders, the striking member, etc. at various points on the swing in relation to the swing plane. Thus, a heretofore unaddressed need exists in the industry to address the aforementioned deficiencies and inadequacies.

SUMMARY

Embodiments of this disclosure provide systems and methods for teaching an athlete the proper swing plane for striking a ball. One embodiment of the system, among others can be implemented including a swing plane component defining a predefined plane around an athlete for swing training, a planar guidance component designed to guide a striking member along the predefined plane, and a securing member designed to couple the striking member to the planar guidance component.

This disclosure also describes methods for swing training that may include the steps of defining an appropriate swing plane, removably contacting a striking member to a swing training device, removably attaching the swing training device to the swing plane, and guiding the striking member along a predefined plane.

Other systems, methods, apparatus, features, and advantages will be or become apparent to one with skill in the art upon examination of the following drawings and detailed description. It is intended that all such additional systems, methods, features, and advantages be included within this description, be within the scope of the present description, and be protected by the accompanying claims.

BRIEF DESCRIPTION OF THE DRAWINGS

The systems and methods according to the disclosure can be better understood with reference to the following drawings. The components in the drawings are not necessarily to scale. Additionally, the drawings are intended for illustration purposes only, and are not intended to limit the disclosure in any way. Moreover, in the drawings, like reference numerals designate corresponding parts throughout the several views.

DETAILED DESCRIPTION

Figure 1:
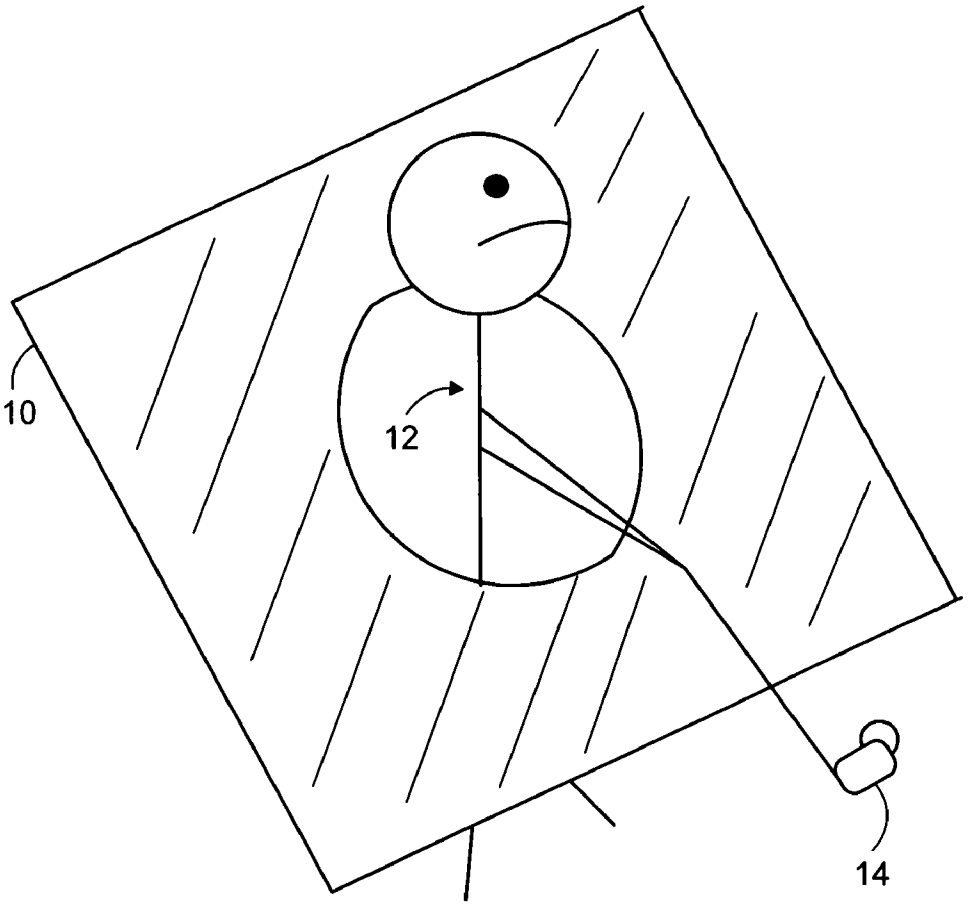
FIG. 1 is a diagram of a golfer practicing his or her swing plane using a swing plane component.
Figure 2:
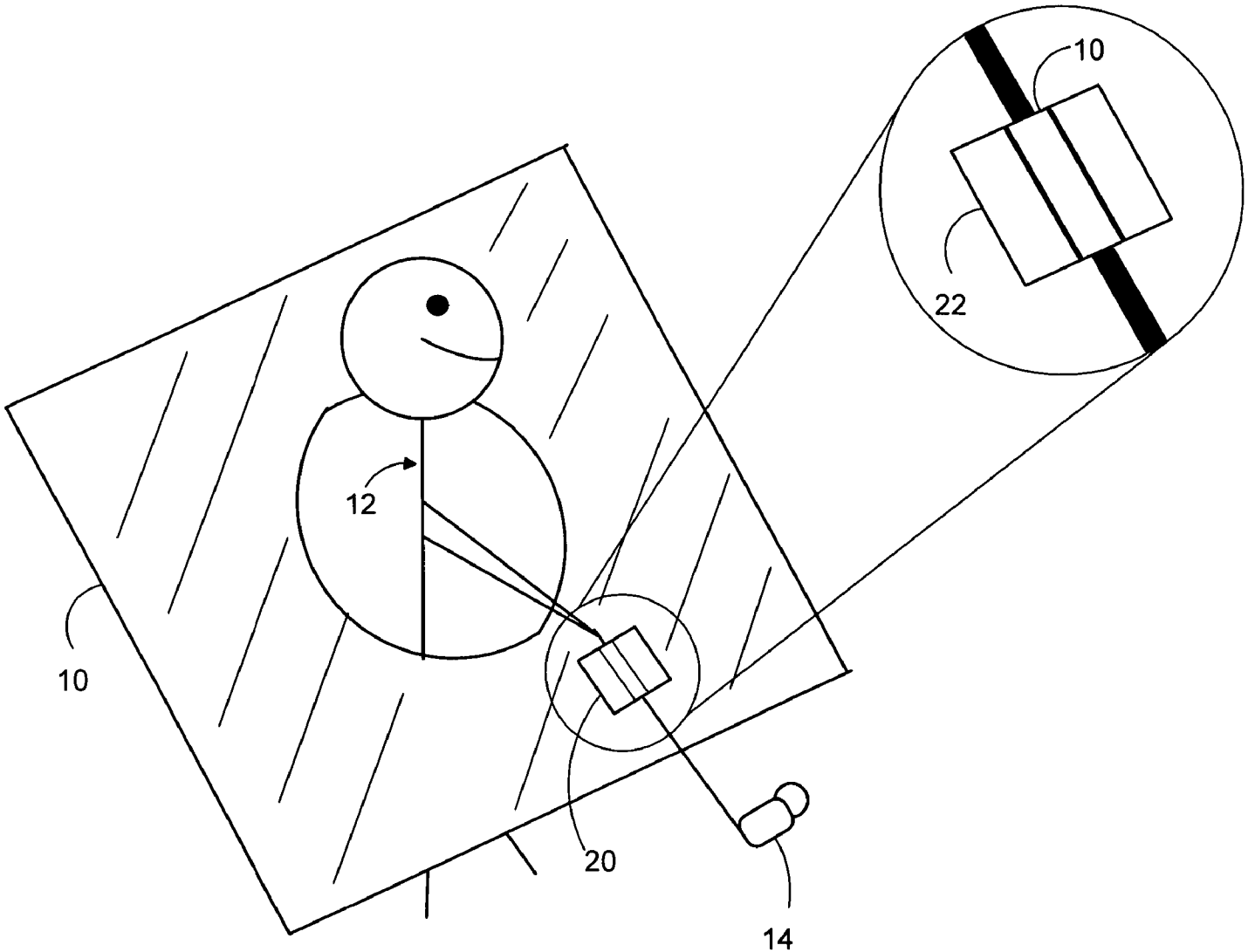
FIG. 2 is a diagram of the golfer in FIG. 1 using a swing training device in conjunction with a swing plane component.

This disclosure relates to an athletic training aid that provides the athlete with feedback regarding his or her swing plane. After adjusting the swing plane component to a desired position, the athlete steps inside the hole of the swing plane component, as shown in FIG. 1 and FIG. 2. After removably attaching a swing training device to a striking member, the athlete takes his or her normal swing, while trying to keep the swing training device in contact with the swing plane component. The swing training device provides the athlete with feedback on his or her swing plane with respect to the desired swing plane as defined by the swing plane component. While the figures enclosed with this description illustrate this with respect to golfing, this is but one possible embodiment, and the figures are not meant to limit the disclosure in this manner.

FIG. 1 is a diagram of a golfer 12 practicing his or her swing plane. FIG. 1 discloses the golfer 12 standing in a swing plane component 10 and practicing his or her swing with a striking member 14. The striking member 14 may take the form of a standard golf club, a "teacher club," or any other object similarly shaped, to provide the desired effect. The golfer 12 may use the swing plane component 10 with the striking member 14 while actually hitting a ball, or without hitting a ball.

The swing plane component 10 may be constructed of any material, including, but not limited to a thin, lightweight material, such nonlimiting examples as wood or plastic. The swing plane component 10 may also have support beams to allow for an angled position of the swing plane. The swing plane component 10 may be adjustable such that it can accommodate different golfers and still achieve the desired results.

The golfer 12 can adjust the swing plane component 10 to adequately define the desired swing plane. The golfer 12 can then place his or her body in the hole of the swing plane component 10. While in this position, the golfer 12 can strike, or pretend to strike a ball that is located on the side of the swing plane component 10 opposite his or her feet. In practicing this motion, the golfer 12 receives feedback as to his or her swing plane with respect to the desired swing plane through observations made based on the distance between the club and the swing plane component 10 at various points of the swing.

As is commonly known, during a golf swing, the striking member 14 is swung around the golfer's body. The swing plane component 10 can be aligned in a manner such that the golfer's desired swing plane is adequately defined according to the position of a target at which the golfer 12 is aiming. However, use of a swing plane component can result in damage to the striking member (golf club, in this nonlimiting example), injury to the athlete, or improper feedback.

FIG. 2 is similar to the diagram of FIG. 1 with the golfer 12 practicing his or her swing plane using the swing training device 20. As shown in FIG. 1 and FIG. 2, the swing plane component 10 defines a desired swing plane, and allows the athlete to guide the striking member 14 along its surface. However, in contrast to FIG. 1, FIG. 2 illustrates a swing training device 20 that can be removably attached to the striking member 14. The swing training device 20 may be configured to remain in contact with the swing plane component 10 throughout the swing. As is evident, the swing training device 20 is securely attached to the striking member 14 in a manner that allows the striking member 14 to rotate while allowing the flat surface of the swing training device 20 to remain in contact with the planar swing plane component 10. The swing training device 20 may be configured such that, while allowing rotation, it will remain attached to the striking member 14. Alternatively, the swing training device 20 may be configured to slide along the length of the striking member 14.

Figure 3:
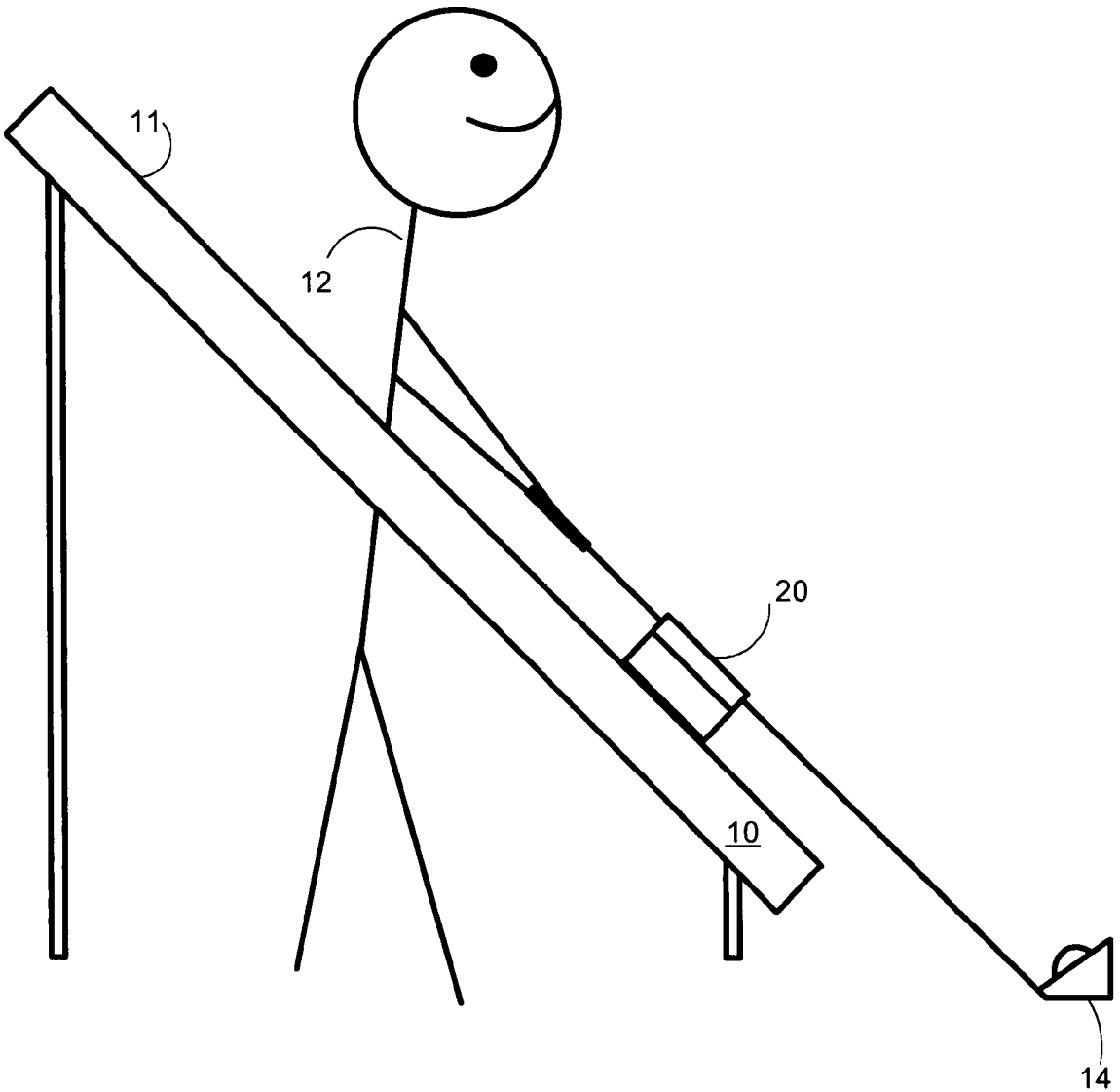
FIG. 3 is a side view diagram of the golfer from FIGS. 1 and 2 illustrating contact of the swing training device with the swing plane component.

FIG. 3 illustrates a side view of the golfer 12 practicing his or her swing plane using the swing training device 20. As shown in FIG. 2, the swing training device 20 is removably attached to the striking member 14. Additionally, throughout the golfer's swing, the bottom surface of swing training device 20 remains in contact with surface 11 of swing plane component 10.

Figure 4:
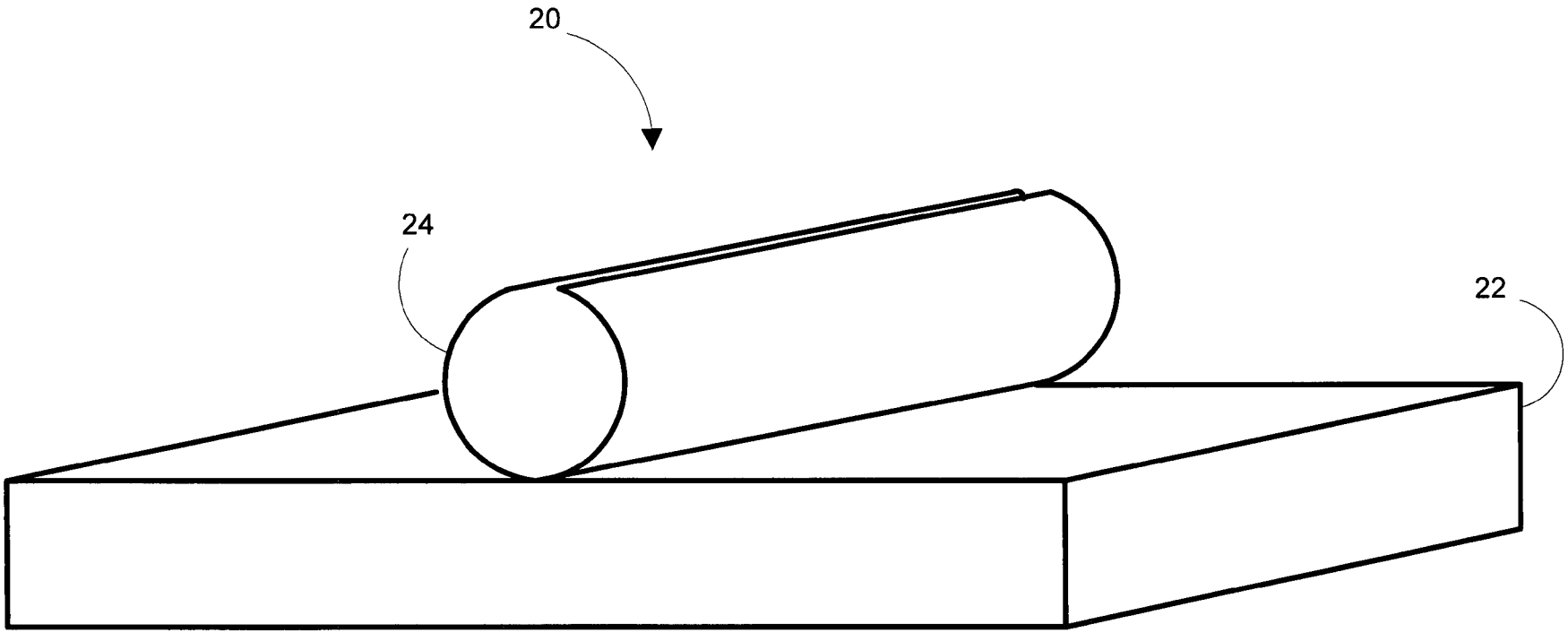
FIG. 4 is a perspective side view of the swing training device of FIGS. 2 and 3.

FIG. 4 illustrates one of a number of embodiments of the swing training device 20. As shown in FIG. 4, a securing member 24 is attached to a planar guidance component 22. The securing member 24 may, but need not, be of a cylindrical or quasi-cylindrical shape with an opening for the striking member 14 to be inserted into and removed from. Additionally, the securing member 24 may simply include one or more points of attachment for securing the striking member 14. The securing member 24 should be constructed of a material that allows the striking member 14 to be securely attached, but also allows for rotation of the striking member 14 within the securing member 24.

The planar guidance component 22 may be constructed of a lightweight material such as wood, plastic, metal or other comparable material. It should be of a weight so as to not interfere with the normal swing of the golfer 12. While illustrated in FIG. 3 as rectangular in shape, the planar guidance component 22 may be of any size or shape. The planar guidance component 22 may be constructed such that it maintains its original shape when subjected to pressures derived from normal use. Other embodiments may include a planar guidance component constructed of a flexible material to allow forgiveness in swing mechanics. As is evident, the thickness of the planar guidance component 22 may correspond to both the strength of its material and the user's personal preference.

In FIG. 4, the planar guidance component 22 and the securing device 24 are attached together using any common means, such as a glue, other bonding agent, nails, screws, clips, Velcro®, etc. The securing device 24 could be attached to the planar guidance component 22 in a permanent fashion, as well as a temporary fashion, which could allow for the interchanging of parts to better adapt to various conditions, such as changing sports and repairing damage to existing parts.

Figure 5:
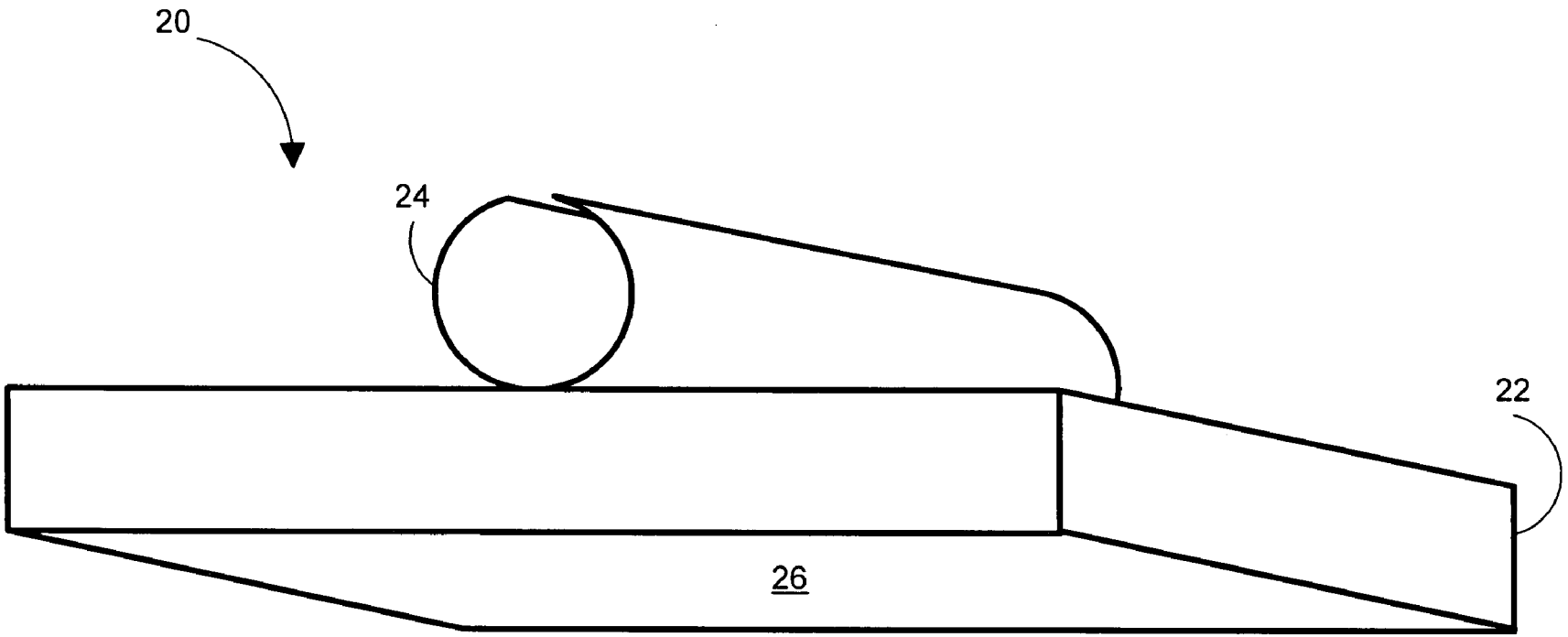
FIG. 5 is another perspective side view of the swing training device of FIGS. 2 and 3.

FIG. 5 illustrates the swing training device 20 of FIG. 4 from a bottom view perspective. FIG. 5 illustrates one embodiment among others where the planar guidance component 22 is constructed such that the surface 26 opposite of the securing member 24 is a flat surface in order to maximize the amount of surface area in contact with surface 11 of the swing plane component 10. It is also conceivable, however, that one may desire to have a minimum amount of surface area in contact with the swing plane component 10 to allow more freedom throughout the swing. A user may desire such a configuration for at least the reason that it more closely simulates actual game conditions.

Figure 6:
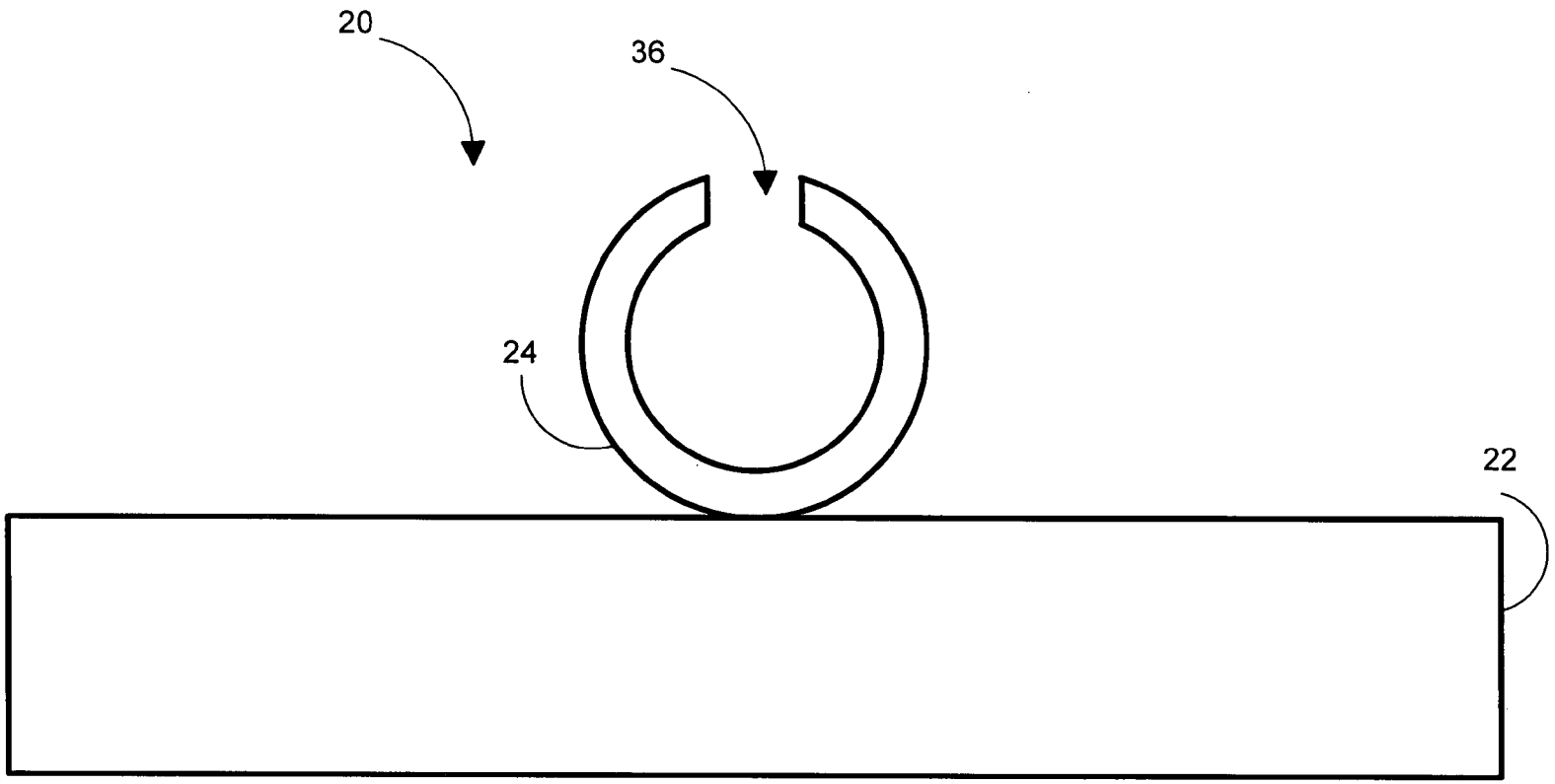
FIG. 6 is a cross sectional side view of the swing training device of FIGS. 2 and 3.

FIG. 6 is a cross sectional side view of one embodiment of the swing training device 20 with the securing member 24 and the planar guidance component 22. FIG. 6 merely illustrates that in one embodiment of the swing training device 20, the securing device 24 includes a gap 36 through which the striking member 14 can be inserted. The gap 36 may be smaller than the diameter of the striking member 14, and the securing member 24 constructed of a material that will bend to allow the striking member 14 to be secured and then return to its original position. Such a configuration will allow the striking member 14 to remain attached to the securing member 24 until removed by the user. While illustrated on the top of the securing device, the gap 36 through which the striking member 14 is inserted may be placed anywhere that allows the striking member 14 to be inserted and removed, while still adequately securing it during use.

Figure 7:
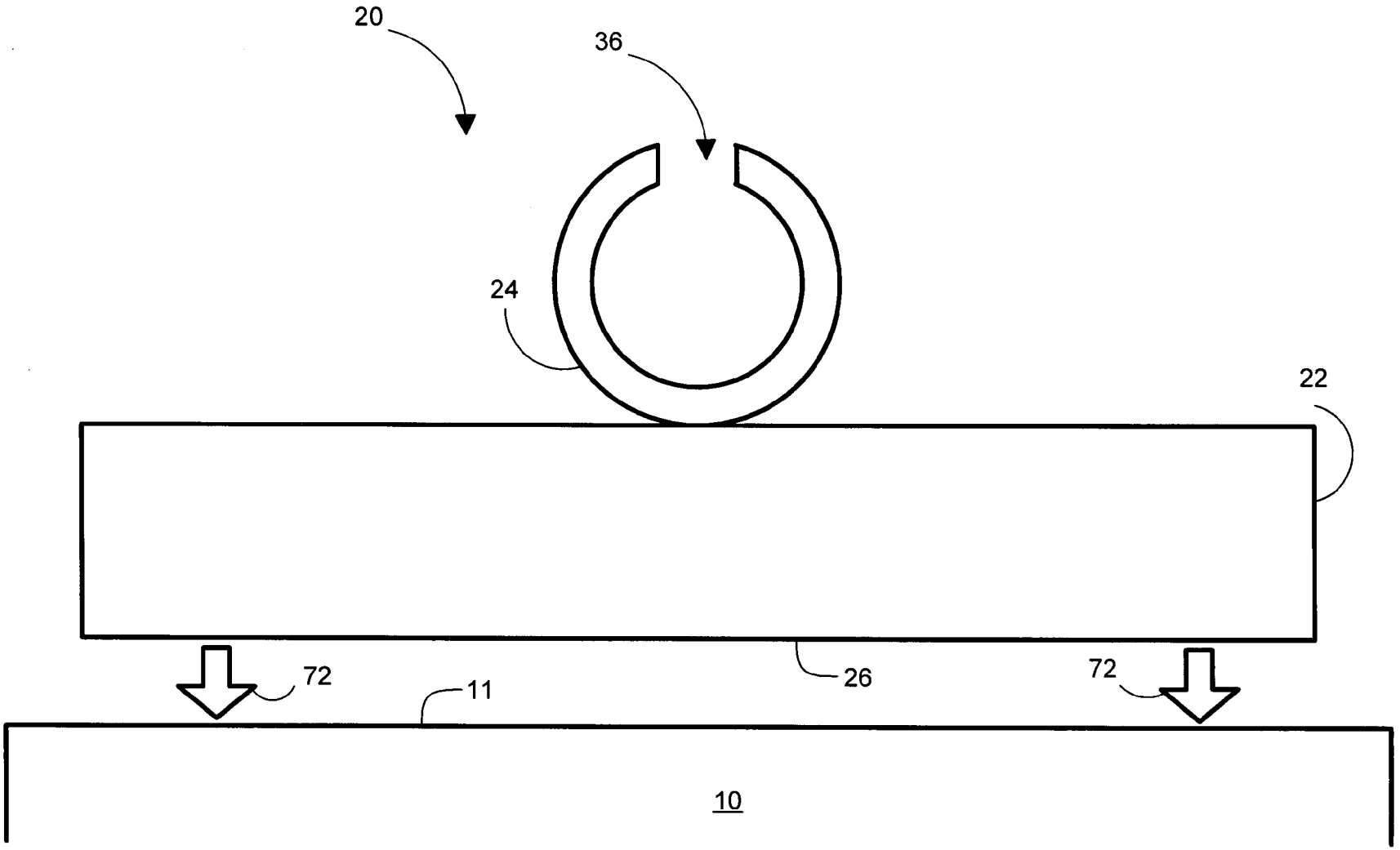
FIG. 7 is a cross sectional side view of the swing training device of FIGS. 2 and 3, illustrating the contact between the swing training device and the swing plane component.

FIG. 7 is an illustration of a cross sectional side view of one embodiment of the swing training device 20 with the securing member 24 and planar guidance component 22. Arrows 72 illustrate that surface 26 of the planar guidance component 22 contacts surface 11 of the swing plane component 10 when the golfer 12 swings the striking member 14.

Figure 8:
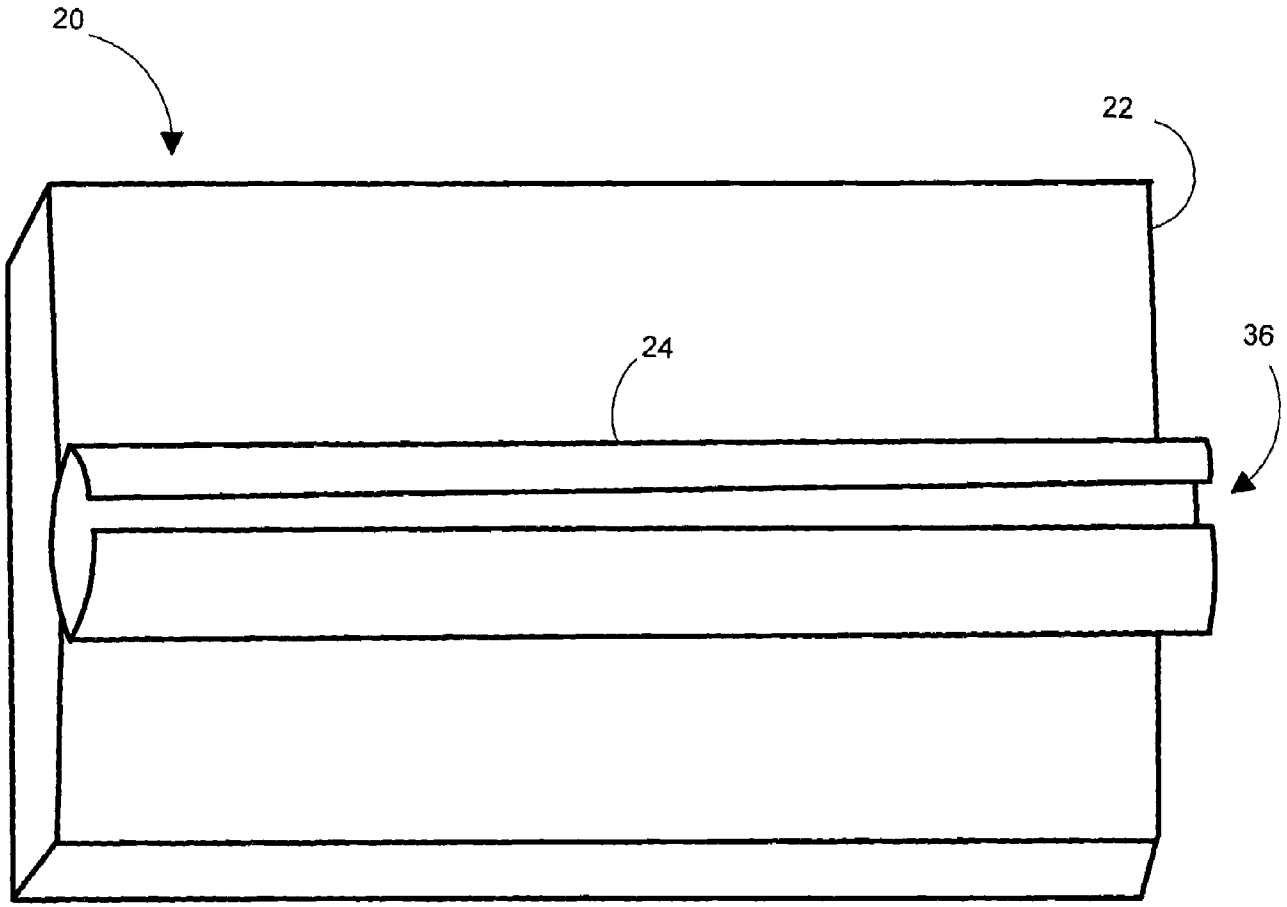
FIG. 8 is a perspective top view of the swing training device of FIGS. 2 and 3.

FIG. 8 is a top perspective view of one embodiment of the swing training device 20 with the securing member 24 and the planar guidance component 22. FIG. 8 illustrates the securing member 24 as extending the length of the planar guidance component 22. However, the securing member 24 may be of any length adequate to provide the desired results, as discussed above. Similarly, securing member 24 need not be a solid cylindrical (or quasi-cylindrical) shape. It is conceivable that securing member include one or more points of attachment that secure the securing member 24 to the striking member 14.

Figure 9:
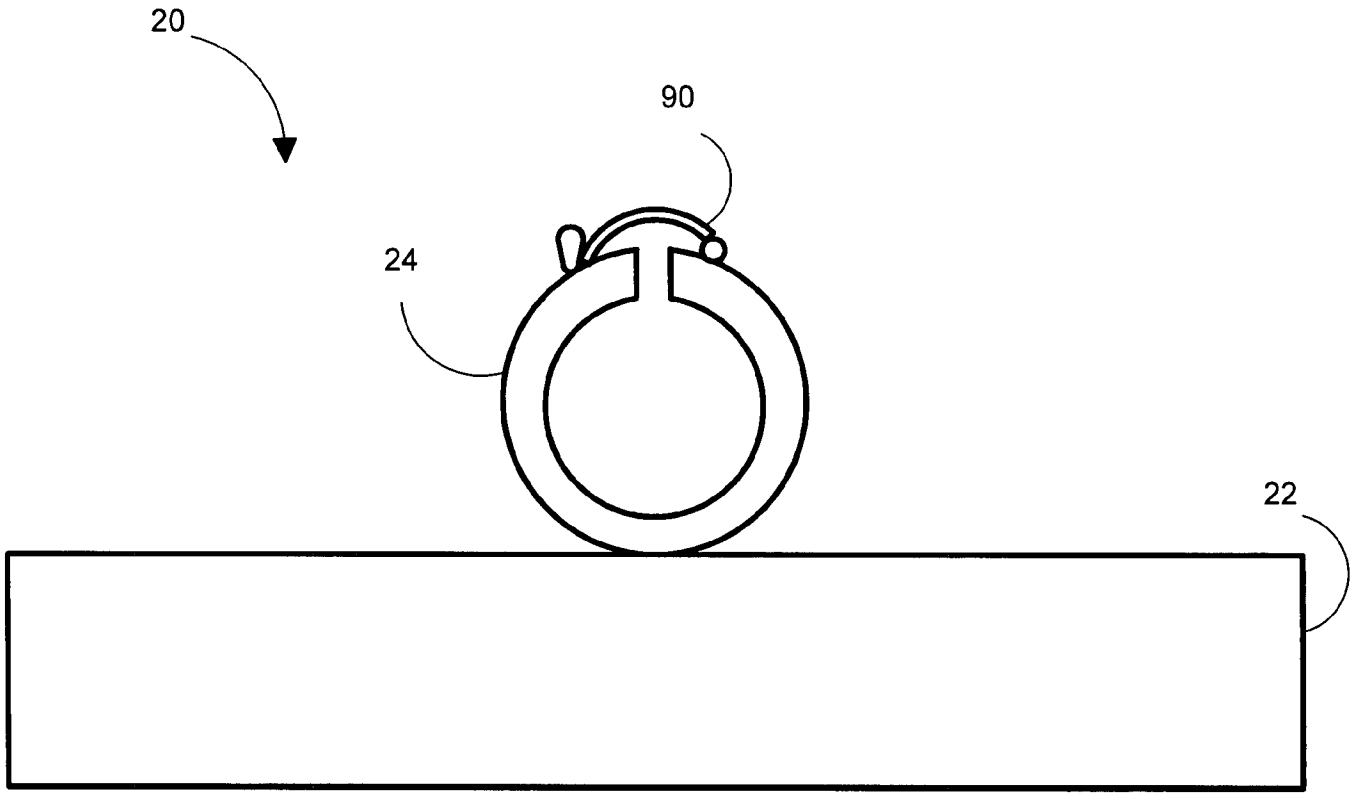
FIG. 9 is another cross sectional side view of another embodiment of the swing training device of FIG. 2.

FIG. 9 is another side view of a different embodiment of the swing training device 20. In this particular embodiment, the securing device 24 includes a latch 90 to further secure the striking member 14. As stated above, the securing member 24 may be constructed to allow the striking member 14 to be adequately secured, while also allowing rotation within the securing member 24. The latch 90 may be permanently or temporarily attached to the securing member 24 through a bonding agent, nails, screws, or any other means commonly known in the art. The latch 90 may be constructed of metal, plastic, or any other material adequate to hold the striking member 14 inside the securing member 24 during use.

Figure 10:
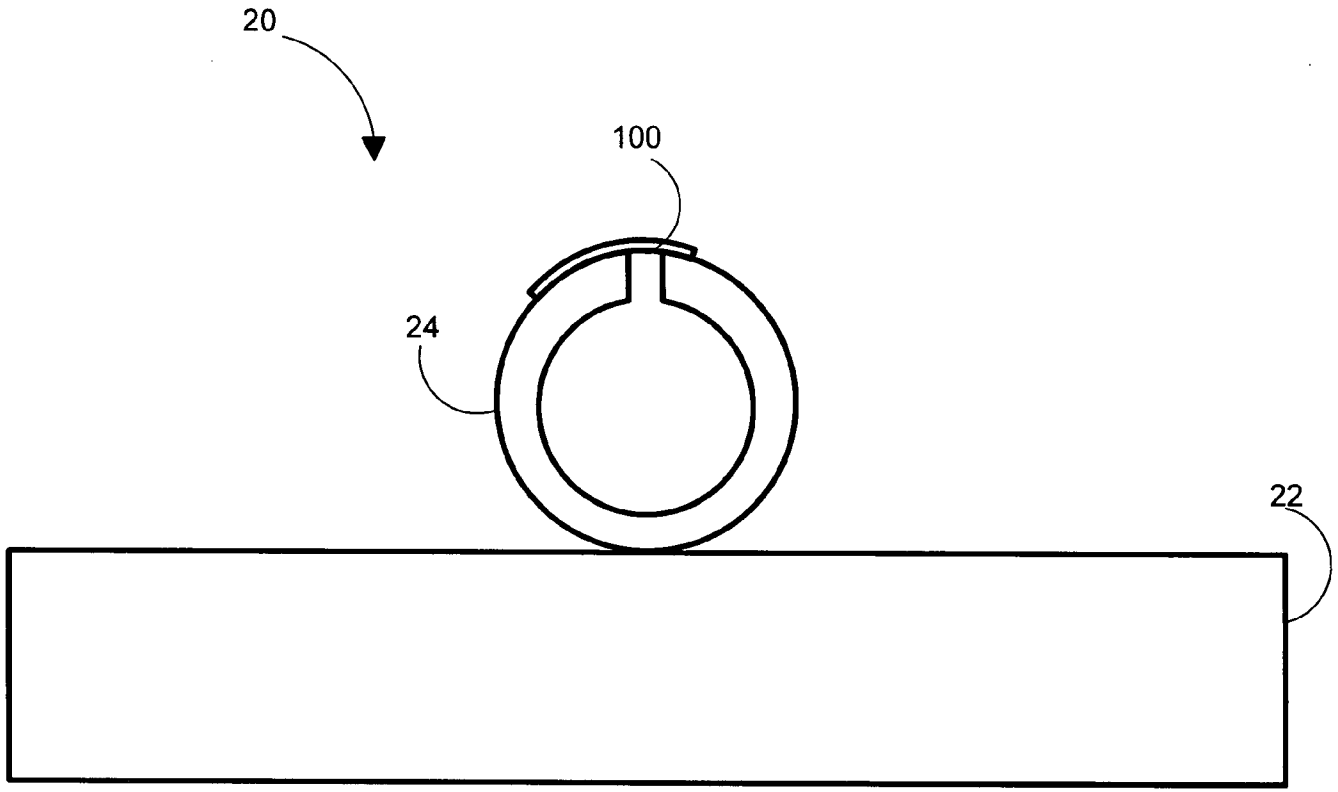
FIG. 10 is yet another cross sectional side view of yet another embodiment of the swing training device of FIG. 2.

FIG. 10 is a side view of yet another embodiment of the swing training device 20. In this embodiment, the securing member 24 may be constructed of nylon, Velcro®, or other flexible material. In FIG. 10, adhesive 100 is used to secure a striking member 14 (from FIGS. 1 and 2) within the securing member 24. The adhesive 100 may include, but is not limited to, a type of bonding agent, Velcro®, zipper, snap, or any other method of removably securing the striking member 14 (from FIGS. 1 and 2) to securing member 24.

It should be emphasized that the above-described embodiments of the present swing training device, particularly, any "preferred" embodiments, are merely possible examples of implementations, merely set forth for a clear understanding of the principles of the swing training device. Many variations and modifications may be made to the above-described embodiments of the present swing training device without departing substantially from the spirit and principles of the swing training device. All such modifications and variations are intended to be included herein within the scope of this disclosure and protected by the following claims.

The invention claimed is:

1. A system for swing training, the system comprising:

a swing plane component defining a swing plane around an athlete and having a flat surface;

a planar guidance component configured to guide a striking member along the swing plane, the planar guidance component having a flat surface that removeably contacts the flat surface of the swing plane component; and a securing member coupled to the planar guidance component, the securing member having a cylindrical shape with a gap that allows insertion and removal of the striking member, the securing member being configured to attach the planar guidance component to the striking member.

2. The system of claim 1, wherein the planar guidance component is shaped to define at least one path guider for guiding the striking member along the defined swing path.

3. The system of claim 1, wherein the securing member further comprises a latch to secure the securing member about the striking member.

4. The system of claim 1, wherein the securing member further comprises an adhesive for securing the securing member to the striking member.

5. The system of claim 1, wherein the securing member is constructed of at least one of plastic and rubber.

6. The system of claim 1, wherein the striking member is a golf club.

7. The system of claim 1, further comprising means for reducing the friction along the predefined plane.

8. The system of claim 1, further comprising means for guiding the striking member along the predefined path while the swing training device is in contact with the predefined plane.

* * * * *